United States Patent [19]

Kerby

[11] 3,995,728

[45] Dec. 7, 1976

[54] ANTI-VANDAL CREDIT CARD GATE

[75] Inventor: Robert A. Kerby, Wallington, England

[73] Assignee: Burroughs Corporation, Detroit, Mich.

[22] Filed: Feb. 12, 1976

[21] Appl. No.: 657,511

[30] Foreign Application Priority Data

July 9, 1975 United Kingdom ..... 28822/75

[52] U.S. Cl. ..... 194/4 D

[51] Int. Cl.[2] ..... G07F 1/06

[58] Field of Search ..... 194/4, 5, 1 E, 6, DIG. 20, 194/4 B, 4 C, 4 D, 4 E, 4 F, 4 G; 232/44, 1 E

[56] References Cited

UNITED STATES PATENTS 3,815,719 6/1974 Streeter et al. ..... 194/4 G

*Primary Examiner*—Stanley H. Tollberg

*Attorney, Agent, or Firm*—Benjamin J. Barish; Karl Stoess; Kevin R. Peterson

[57] ABSTRACT

A vandal-resistant gate which is constructed in such a manner that it only opens wide enough to accommodate a credit card but not coins or other foreign objects. In this manner the gate allows the entry of a credit card but resists the insertion of coins or other objects which would immobilize the machine.

4 Claims, 6 Drawing Figures

ANTI-VANDAL CREDIT CARD GATE

SUMMARY OF THE INVENTION

Cash dispensers, also known as remote tellers, have been used by banks for a number of years to allow authorized clients to withdraw cash from such dispensers when the bank is closed or at any time as a matter of convenience. The client owns a credit card which has to be inserted into the cash dispenser. After automatic verification a specified amount in bank notes is dispensed.

After remote tellers were put into operation it was noticed that various acts of vandalism occurred. Now most machines of this type have "anti-vandal doors" which furnish considerable protection. It was found, however, that yet another act of vandalism was committed at the slot into which the client's credit card is inserted for decoding inside of the machine.

Vandals pressed coins or hard foreign objects into this slot, thereby immobilizing the entire machine until the foreign objects could be removed.

To obviate this annoyance a vandal-resistant gate has been provided. The gate is the device into which the credit card is inserted. This gate is constructed in such a manner that it only opens wide enough to accommodate a credit card but makes it impossible to squeeze a coin or other foreign object through the slot. It is therefore an object of the present invention to provide a gate which allows the entry of a credit card but resists the insertion of other items, such as coins.

In a device for allowing the insertion of a credit card into a cash dispenser or the like, but preventing the insertion of coins or other foreign objects, the invention comprises two movable portions in superimposed position, each of said portions having two complementary inclined surfaces toward their outer ends, said surfaces allowing relative sliding of both portions so as to form a slot opening therebetween, one block each attached to both movable portions, respectively, said blocks being slightly closer together than the width of an inserted credit card; and spring means urging said movable portions against each other so as to keep them interengaged in their normal position.

DESCRIPTION OF THE PREFERRED EMBODIMENT

Figure 1:
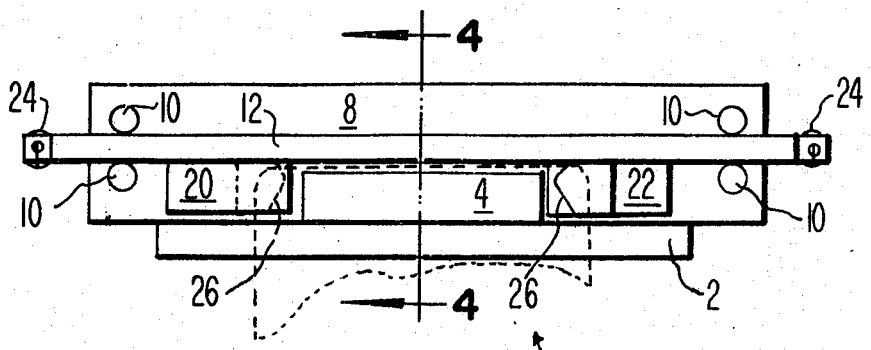
FIG. 1 is a top elevation of the unit which provides for insertion of a credit card into a cash dispensr (remote teller) and ejection therefrom.
Figure 4:
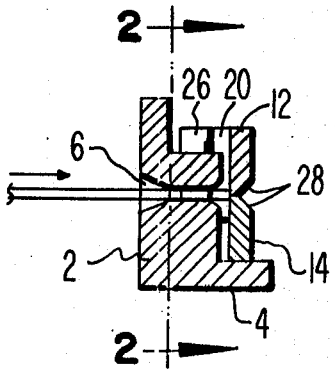
FIG. 4 is a cross section along the line 4 — 4 in FIG. 1.

FIG. 1 which shows a top view of a card inserting and ejecting unit of a cash dispenser (remote teller) indicates in connection with the cross section of FIG. 4 how a credit card can be inserted into the machine. A front plate 2 which has an inner block portion 4 forms the outside of the unit.

A slot 6 which is illustrated in FIG. 4 but not actually visible in FIG. 1 extends through the front plate 3 with its block portion 4 so as to allow lengthwise insertion of a credit card.

Figure 2:
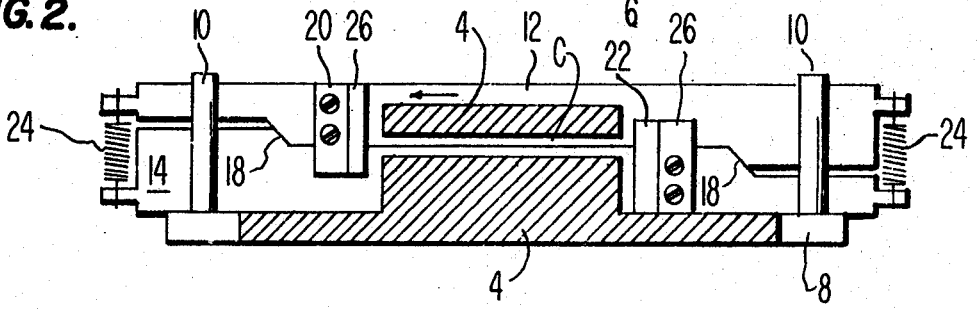
FIG. 2 is a front view of the device shown in FIG. 1 with the front plate removed. The unit is in its closed position.
Figure 3:
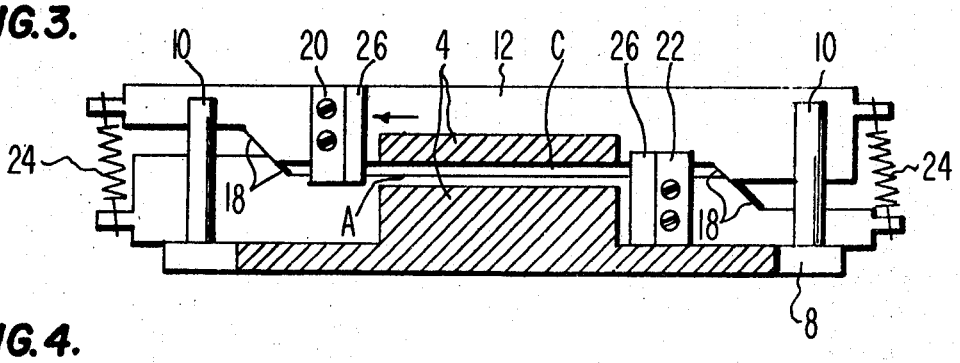
FIG. 3 is the same view as FIG. 2. Only the unit is not closed but has been opened for insertion of a credit card.
Figure 5:
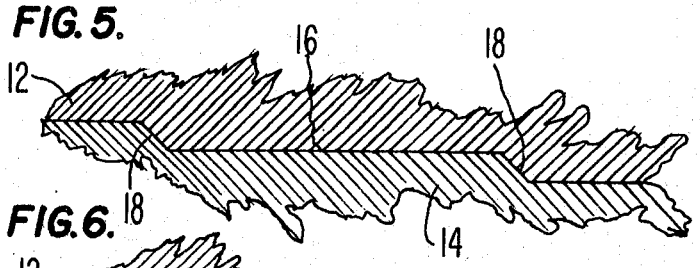
FIG. 5 shows schematically how the two movable portions of the device are closed against the insertion of any object into the machine.
Figure 6:
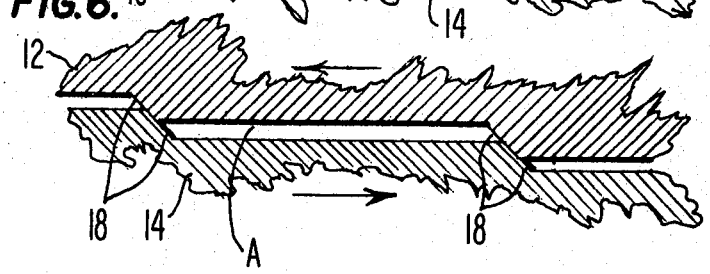
FIG. 6 shows schematically how a gap between the two movable portions of the device has been opened so as to allow insertion of a credit card.

A frame 8 with posts 10 is provided to hold an upper movable portion 12 and a complementary lower portion 14, which portions are superimposed and engage each other at a vertical line 16 when the unit is in its closed position (FIG. 2). Beveled planes 18 (FIGS. 2, 3, 5 and 6) allow relative movements of the movable portions 12 and 14 against one another, thus causing an aperture A between them (FIGS. 3 and 6).

Each of the movable portions 12 and 14 has on its front side a block attached thereto. Block 20 at the upper movable portion 12 and block 22 at the lower movable portion 14 are visible in FIGS. 1, 2 and 3. Block 20 also appears in FIG. 4. The blocks have inclined surfaces 26 suitable for engagement with the edges of an inserted credit card.

The movable portions 12 and 14 are pressed together by spring means 24 which urge them against each other so that they are kept inter-engaged in normal position which means that no slot is formed between them. At the rear side of the portions 12 and 14 there are inclined edges 28 (FIG. 4) along the vertical line 16. Their purpose is explained under "Operation".

OPERATION

When a credit card C is inserted into slot 6 in the front plate 2, the card is urged against the inclined surfaces 26 of the blocks 20 and 22. By pushing the card further into slot 6, the upper movable portion 12 is urged sideways against the tension of spring means 24 due to the card's engagement with block 20. The lower movable portion 14 is urged sideways in the opposite direction due to the card's engagement with block 22. This is the case because in normal position the distance between the ends of blocks 20 and 22 is smaller than the width of the inserted credit card.

By pressure of the card's edges against the inclined surfaces 26 of the blocks 20 and 22 a relative movement of the two portions 12 and 14 occurs which is schematically illustrated in FIG. 6. It is obvious that by such outward movement of both portions a slot is formed which is just wide enough to let the credit card enter into the machine.

The anti-vandal effect of the device can now be clearly seen. If any other object than a credit card of correct width is inserted, the blocks 20 and 22 are not engaged. This means that no opening pressure is exerted upon them and the movable portions 12 and 14 remain in interengagement along line 16 (no slot opening) as schematically illustrated in FIG. 5. In this manner all attempts by vandals to immobilize a cash dispenser by means of inserting foreign objects, like coins, are foiled.

It is shown in FIG. 4 that by means of the inclined edges 28 at the rear side of the movable portions 12 and 14 the inserted credit card can be pushed back so as to exit from slot 6 without the need of any opening mechanism of the type provided by blocks 20 and 22.

What is claimed is:

1. In a device for allowing the insertion of a credit card into a cash dispenser or the like, but preventing the insertion of coins or other foreign objects, the combination comprising two movable portions in superimposed position, each of said portions having two complementary inclined surfaces toward their outer ends, said surfaces allowing relative sliding of both portions so as to form a slot opening therebetween, one block each attached to both movable portions, respectively, said blocks being slightly closer together than the width of an inserted credit card; and spring means urging said movable portions against each other so as to keep them interengaged in their normal position.

2. The combination as claimed in claim 1, wherein a front plate is disposed at the outside of said unit, said front plate having an aperture for insertion of a credit card.

3. The combination as claimed in claim 1, further providing a base with a plurality of pairs of posts, with said movable portions being disposed within said pairs of posts.

4. The combination as claimed in claim 2, wherein beveled edges are provided at that side of the movable portions which is opposite the front plate, said beveled surfaces extending along the interengaging edges of said two portions.

* * * * *